United States Patent [19]

Yoshihara

[11] Patent Number: 4,851,314

[45] Date of Patent: Jul. 25, 1989

[54] ELECTROPHOTOGRAPHIC PHOTOSENSITIVE MEMBER WITH COMBINED POLYCARBONATE RESINS

[75] Inventor: Toshiyuki Yoshihara, Mitaka, Japan

[73] Assignee: Canon Kabushiki Kaisha, Tokyo, Japan

[21] Appl. No.: 948,066

[22] Filed: Dec. 31, 1986

[30] Foreign Application Priority Data

Jan. 9, 1986 [JP] Japan ..... 61-1249

[51] Int. Cl.[4] ..... G03G 5/14

[52] U.S. Cl. ..... 430/59; 430/58; 430/96

[58] Field of Search ..... 430/58, 59, 96

[56] References Cited

U.S. PATENT DOCUMENTS 4,265,990 5/1981 Stolka et al. ..... 430/59
4,489,147 12/1984 Chang ..... 430/59 X

FOREIGN PATENT DOCUMENTS 59-71057 4/1984 Japan ..... 430/58
60-19151 1/1985 Japan ..... 430/59
60-213953 10/1985 Japan ..... 430/59

*Primary Examiner*—Roland E. Martin
*Attorney, Agent, or Firm*—Fitzpatrick, Cella, Harper & Scinto

[57] ABSTRACT

An electrophotographic photosensitive member comprises a photosensitive layer on an electroconductive substrate, and photosensitive layer comprising at least one polycarbonate resins (I) having a number average molecular weight of $1.5\times10^4$ or less and at least one of polycarbonate resins (II) having a number average molecular weight of $4.5\times10^4$ or more, said polycarbonate resin (I) being contained at a proportion of 30 parts by weight to 95 parts by weight based on the composition comprising the polycarbonate resins (I) and (II).

8 Claims, No Drawings

ELECTROPHOTOGRAPHIC PHOTOSENSITIVE MEMBER WITH COMBINED POLYCARBONATE RESINS

BACKGROUND OF THE INVENTION

1. Field of the Invention

This invention relates to an electrophotographic photosensitive member by use of an organic photoconductive material, above all a laminated type electrophotographic photosensitive member having a photosensitive layer with a laminated structure having a charge generation layer and a charge transport layer provided by coating thereon.

2. Related Background Art

The photosensitive layer surface of an electrophotographic photosensitive member receives electrical, thermal and further mechanical external force by various processes in an electrophotographic copying machine such as corona charging, toner development, transfer onto paper, cleaning treatment, etc. Accordingly, the following problems have ensued by practicing repeatedly an electrophotographic process. First, through the mutual interaction between the paper powder generated from the transfer paper under highly humid conditions, ozone generated by corona discharging and further nitrogen oxides, etc., formed by ozone, low resistance materials are adhered on the surface of the electrophotographic photosensitive member. Whereupon there occurs a phenomenon that the image formed becomes indistinct as it blurs (hereinafter called "image flow"). Next, there are problems such as elevation of the residual potential accompanied by carrier trapping formed within the charge transport layer and at the interface between the charge transport layer and the charge generation layer. Also, a phenomenon occurs that the charge transporting material in the vicinity of the photosensitive layer surface is deteriorated by ozone to become reversibly low in resistance whereby the image becomes blurred (hereinafter called "unfocused image"). Further, friction damage and abrasion by mechanical external force also occur. These will all bring about lowering in image quality, whereby no stable sharp image can be constantly obtained.

The problems as mentioned above as influenced greatly by the characteristics of the binder resin contained in the charge transport layer in an electrophotographic photosensitive member having a charge transport layer laminated on a charge generation layer.

On the other hand, each layer of such an electrophotographic photosensitive member is generally formed by coating, and the binder resin has great influence on its coatability, and therefore production stability.

Accordingly, selection of the binder resin for a charge transport layer is very important, and at the same time, it is extremely difficult to find a material which can satisfy all of the demands as mentioned above. As the material to be used as the binder resin, there have been heretofore proposed methacrylic resins, acrylic resins, polystyrene, polyester, polycarbonate, polyarylate, polysulfone, etc., either as single product, or copolymers or blends. Among them, polycarbonate resins have overall excellent characteristics and have been practically applied. When a polycarbonate resin is used as the binder resin, there is little deterioration of electrophotographic characteristic such as residual potential elevation accompanied with repeated copying, whereby stable latent images can be obtained.

Also, due to excellent abrasion resistance, durability is also excellent against various kinds of mechanical external forces. However, the surface layer containing a polycarbonate has a drawback in that the image flow phenomenon is very liable to occur. This may be considered because the low resistance materials adhered on the photosensitive member surface which causes image flow can be removed with difficulty due to the abrasion resistance of polycarbonate. Thus, this is nothing but the adverse effect of the excellent mechanical durability of polycarbonate. For solving this problem, there must be employed a means to provide a dehumidifying heater for the photosensitive member, or a means to clean the surface by roller cleaning. Accordingly, there ensues the problems such as increased costs, increase of power consumption, temperature elevation, image irregularity due to cleaning roller, etc., accompanied with such means. Particularly, when it is aimed to make the electrophotographic copying machine smaller and widely spread, employment of image flow preventing means as described above is further difficult also in aspect of space.

On the other hand, another drawback of a polycarbonate containing photosensitive layer is the point that unfocused image is liable to occur. While it is not clear how the polycarbonate which is the binder resin participates in ozone deterioration of the charge transport material, it may be considered to have an effect on arrangement and orientation of the charge transport material in the charge transport layer, which makes the vicinity of the surface conspicuously lower in resistance when subjected to ozone deterioration. For solving this problem, it is necessary to maintain constantly the ozone concentration at a low level by controlling the evacuation state around the photosensitive member. Accordingly, new factors for enlargement of copying device such as enlargement of evacuation fan and motor, arrangement of evacuation duct as well as increased costs are further provided.

As described above, when using a photosensitive layer containing a polycarbonate resin, there has been the drawback that the above problems occurred during attempts to make an electrophotographic copying machine on a small scale, at lower costs, thereby requiring suitable expensive countermeasures.

SUMMARY OF THE INVENTION

The primary object of the present invention is to overcome the drawbacks as described above and provide an electrophotographic photosensitive member which can maintain the excellent electrophotographic characteristics of polycarbonate and is yet free from image deterioration such as image flow and unfocused image. The present inventors have studied intensively the problems as described above, and consequently have found that the image deterioration after repeated copying as described above can be prevented if the binder resin at the surface of photosensitive member has adequate abrasion resistance. It has been found that the abrasion characteristic of the photosensitive member for electrophotography can be made adequate to improve durability by use of polycarbonate resins having molecular weights within specific ranges at a ratio within a specific range. The present invention has been accomplished on the basis of such a finding.

More specifically, the present invention provides an electrophotographic photosensitive member having a photosensitive layer on an electroconductive substrate, said photosensitive layer comprising at least one of polycarbonate resins (I) having a number average molecular weight of $1.5\times10^4$ or less and at least one of polycarbonate resins (II) having a number average molecular weight of $4.5\times10^4$ or more, said polycarbonate resin (I) being contained at a proportion of 30 parts by weight to 95 parts by weight in the composition comprising the polycarbonate resins (I) and (II).

DESCRIPTION OF THE PREFERRED EMBODIMENTS

Generally speaking, the strength of a resin (abrasion resistance, hardness) is higher as the molecular weight is increased, but the strength does not increase further if the molecular weight and is increased higher than a certain level of molecular weight, but exhibits a constant value. On the other hand, the strength is gradually lowered as the molecular weight is lower, and is abruptly lowered when the molecular weight is further reduced to a certain level or lower. In the case of polycarbonate resins, the molecular weight where the strength is abruptly lowered is about 1.5 to $2.0\times10^4$. Adequate abrasion characteristics can be imparted by containing to some extent a resin having a molecular weight lower than that value.

Since the photosensitive layer containing such a polycarbonate resin has adequate abrasion characteristic, even when a conventional cleaning means is employed, low resistance adherents can be removed from the photosensitive layer surface by minute friction, and also the portion subjected to ozone deterioration can be successively removed, whereby the surface can be constantly maintained clean to cause no image deterioration.

As a matter of course, the photosensitive member of the present invention tends to be weaker against mechanical external force such as friction, etc., but even so it has sufficient strength as compared with other binder resins in general. Particularly, on a small scale, widely spread type copying machine in which the number of repeated copies is small, no bad influence is exerted.

In the present invention, the composition ratio of the blend composition of the polycarbonate resins (I) and (II) may be preferably such that the polycarbonate resin (I) having a number average molecular weight of $1.5\times10^4$ or less are 30 parts by weight to 95 parts by weight based on the blend composition as mentioned above. If the polycarbonate (I) is smaller than 30 parts by weight, no adequate abrasion characteristic can be imparted and no effect as mentioned above can be recognized. On the other hand, if it exceeds 95 parts by weight, there are involved problems such as excessive abrasion characteristic and lowering in viscosity. Also, the molecular weight of the polycarbonate (I) may desirably be $1.5\times10^4$ or less at which the strength is abruptly changed as described above.

On the other hand, the polycarbonate (II) is used to cancel the problems when the low molecular weight polycarbonate (I) is used alone. That is, the problems are lowering in image quality due to excessive abrasion characteristic, and non-uniform film thickness of the charge transport layer due to lowering in viscosity of the coating solution when forming a charge transport layer. For this reason, the number average molecular weight of the polycarbonate (II) may preferably be $4.5\times10^4$ or more.

At a molecular weight less than $4.5\times10^4$, the viscosity increasing effect becomes smaller, whereby the blend ratio relative to the polycarbonate (I) must be increased to 70 parts by weight or more, whereby it becomes impossible to control adequate abrasion characteristic. The polycarbonate resin to be used in the present invention contains a polymer comprising at least one of the repeating units shown by the following formula [A] as the component.

Formula [A]

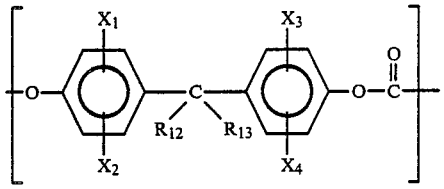

(wherein each of $R_{12}$ and $R_{13}$ is hydrogen atom, alkyl group or aromatic group, and $R_{12}$ and $R_{13}$ may also form a cyclic structure together with the carbon atom to which they are bonded; each of $X_1$, $X_2$, $X_3$ and $X_4$ represents hydrogen atom, halogen atom, alkyl group of aryl group).

The polycarbonate resin to be used in the present invention can be obtained by, for example, the polycarbonate synthesis method in general such as the phosgene method, etc., by use of at least one of the diol compounds represented by the following formula [B].

Formula [B]

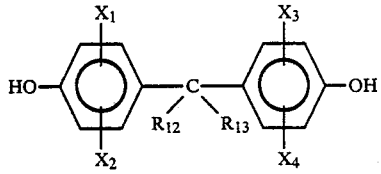

(wherein $R_{12}$, $R_{13}$, $X_1$, $X_2$, $X_3$ and $X_4$ have the meanings as defined above).

Specific examples of the above diol compounds used in the present invention are shown below by the structural formulae, but the present invention is not limited thereto.

Specific examples of the formula [B]:

Structural formula (1)

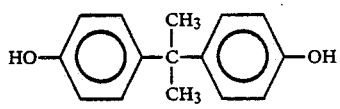

(2)

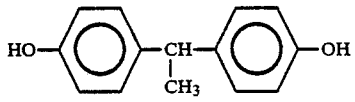

(3)

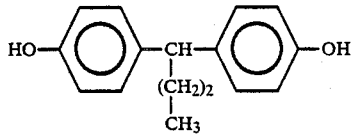

-continued
Structural formula
(4)
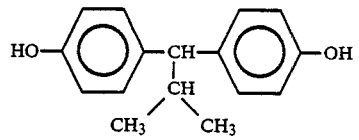
(5)
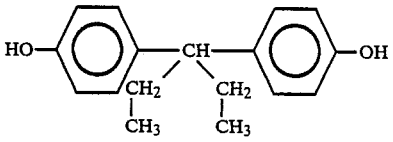
(6)
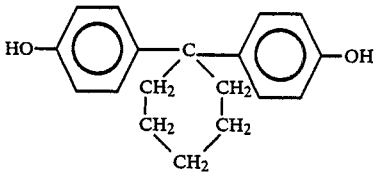
(7)
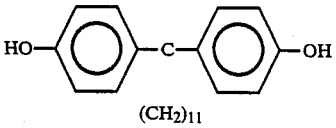
(8)
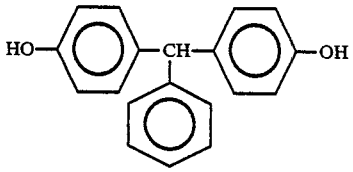
(9)
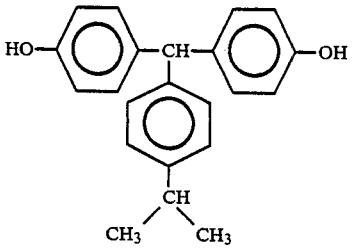
(10)
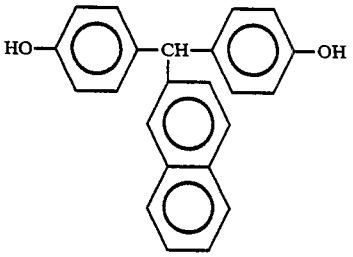
(11)
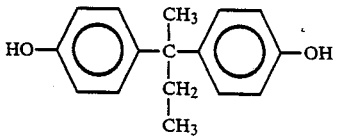
-continued
Structural formula
(12)
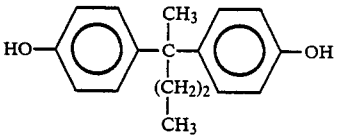
(13)
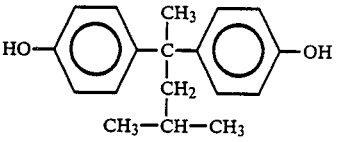
(14)
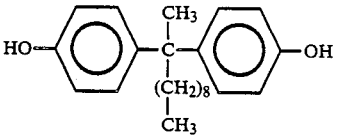
(15)
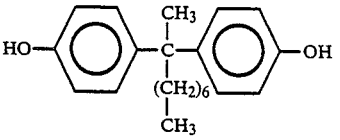
(16)
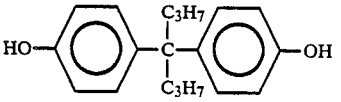
(17)
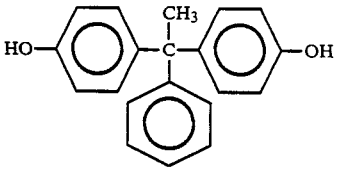
(18)
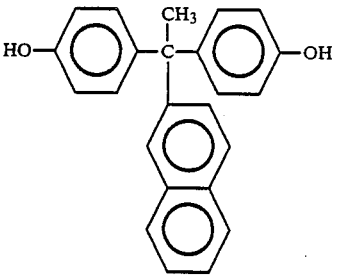
(19)
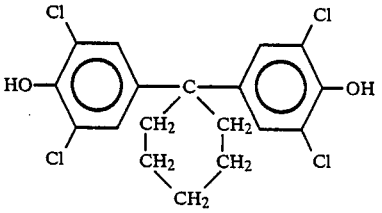

-continued (20)

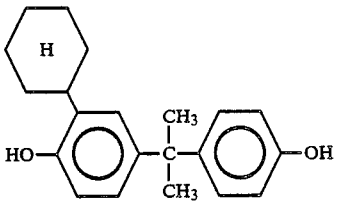

(21)

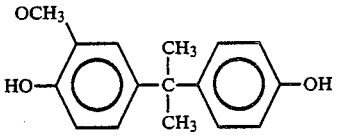

(22)

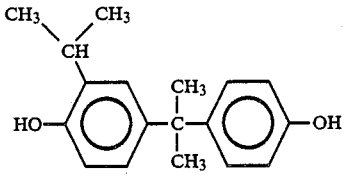

(23)

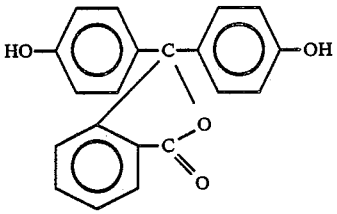

(24)

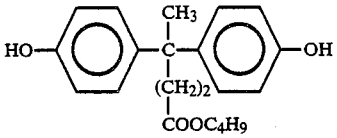

(25)

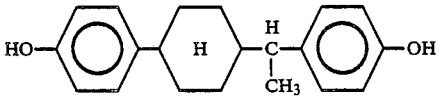

(26)

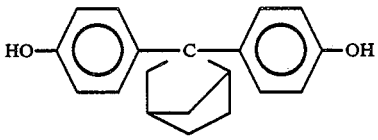

(27)

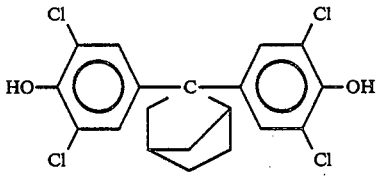

(28)

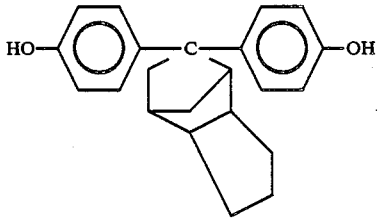

-continued (29)

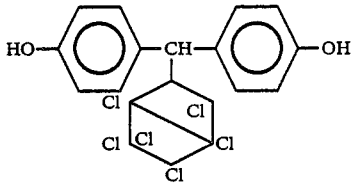

(30)

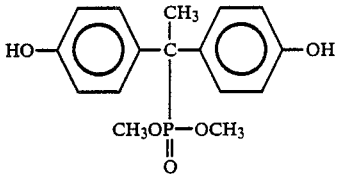

(31)

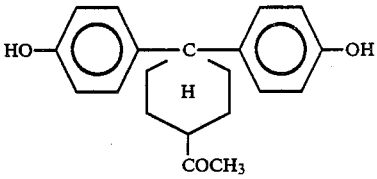

When preparing a charge transport layer by use of the blend composition of the polycarbonate resins (I) and (II) as described above, the charge transporting substance which can be used may include pyrene; carbazole type compounds such as N-ethylcarbazole, N-isopropylcarbazole, etc.; hydrazone type compounds such as N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, etc.; pyrazoline type compounds such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl (2)]-3-(p-diethylaminostyryl)-5-(p-diethylaminophenyl)-pyrazoline, 1-[pyridyl (2)]-3-(p-diethylaminostyryl)-5-(p-diethylaminophenyl)pyrazoline, 1-[6-methoxy-phyridyl (2)]-3-(p-diethylaminostyryl)-5-(p-diethylaminophenyl) pyrazoline, 1-[pyridyl (3)]-3-(p-diethylaminostyryl)-5-(p-diethylaminophenyl)pyrazoline, 1-[lepidyl (2)]-3-(p-diethylaminostyryl)-5-(p-diethylaminophenyl)pyrazoline, 1-[pyridyl (2)]-3-(p-diethylaminostyryl)-4-methyl-5-(p-diethylaminophenyl)pyrazoline, 1-[pyridyl (2)]-3-(α-methyl-p-diethylaminostyryl)-5-(p-diethylaminophenyl) pyrazoline, 1-phenyl-3-(p-diethylaminostyryl)-4-methyl-5-(p-diethylaminophenyl)-pyrazoline, 1-phenyl-3-(α-benzyl-p-diethylaminostyryl)-5-(p-diethylaminophenyl)pyrazoline, spiropyrazoline, etc.; oxazole type compounds such as 2-(p-diethylaminostyryl)-6-diethylaminobenzoxazole, 2-(p-diethylaminophenyl)-4-(p-dimethylaminophenyl)-5-(2-chlorophenyl)-oxazole, etc., thiazole type compounds such as 2-(p-diethylaminostyryl)-6-diethylaminobenzothiazole, etc.; triarylmethane type compounds such as bis(4-diethylamino-2-methylphenyl)-phenylmethane, etc.; polyarylalkane type compounds such as 1,1-bis(4-N,N-diethylamino-2-methylphenyl)-heptane, 1,1,2,2-tetrakis(4-N,N-dimethylamino-2-methylphenyl)ethane, etc.

When preparing the electrophotographic photosensitive member of the present invention, as the substrate, a cylindrical cylinder or film made of a metal such as aluminum, stainless steel, etc., paper, plastic, etc., may be used. On these substrates, a subbing layer (adhesive layer) having the barrier function and the subbing function can be provided.

The subbing layer is provided for the purpose of improving adhesion of the charge generation layer, improving coating workability, protecting the substrate, coating of the defect on the substrate, improving charge injectability from the substrate, protecting of the photosensitive layer against electrical destruction, etc. As the material for the subbing layer, there have been known polyvinyl alcohol, poly-N-vinylimidazole, polyethylene oxide, ethyl cellulose, methyl cellulose, ethyleneacrylic acid copolymer, casein, polyamide, copolymerized nylon, glue, gelatin, etc. These may be individually dissolved in a suitable solent before coating on the substrate. The film thickness about 0.2 to 2 μm.

The charge generation layer may be formed by dispersing a charge generation pigment together with 0.5 to 4-fold amount of a binder resin and a solvent well according to the method by use of a homogenizer, sonication, ball mill, vibrating ball mill, sand mill, attritor, roll mill, etc., followed by coating and drying. The thickness of the charge generation layer is about 0.1 to 1 μm.

The charge transport layer is formed by coating a solution of the charge transporting substance and the blend composition of the polycarbonate resins (I) and (II) as described above in a solvent on the charge generation layer. The mixing ratio of the charge transporting substance and the polycarbonate resin blend composition is about 2:1 to 1:2. The film thickness of the charge transport layer is generally 5 to 40 μm, preferably 8 to 25 μm. As the solvent, there may be employed ketones such as cyclohexanone, etc., esters such as methyl acetate, ethyl acetate, etc., ethers such as THF, chlorine type hydrocarbons such as chlorobenzene, chloroform, carbon tetrachloride, etc.

According to the present invention, by use of the polycarbonate resins having molecular weights within specific ranges (by combining at a ratio within a specific range) in the photosensitive layer, an electrophotographic photosensitive member excellent in durability which can be prevented from image quality deterioration such as image flow or unfocused image can be provided.

The electrophotographic photosensitive member of the present invention can be utilized not only for electrophotographic copying machines but can also be used widely for electrophotographic application fields such as laser printer, CRT printer, electrophotographic printing system, etc.

The present invention is described below by referring to Examples.

The molecular weight of polycarbonate, the viscosity of charge transport layer coating solution and abrasion characteristic of the resin coated film were measured under the conditions as described below.

(a) Molecular weight (Mw)

Measurement by gel permeation chromatography (RGC);

Device: "Hight Speed Liquid Chromatograph 244"; produced by waters Co.;

Column: one colum of "GMH", produced by Toyo Soda Co.;

Standard substance: standard polystyrene produced by Toyo Soda Co., maximum molecular weight $448\times10^4$ Measurement conditions:

Sample preparation: polycarbonate 10 mg/tetrahydrofuran 4 ml;

Amount injected: 200 μl

Solvent: tetrahydrofuran

Flow rate: 1 ml/min

Temperature: 23±1° C.

Detector: differential refractometer (b) Viscosity:

Device: "Single Cylinder Type Rotary Viscometer Model VS-Al", produced by Seiki Kogyo Kenkyusho;

Measurement conditions: sample amount: 100 ml/100 ml disposable cup measured value one minute later by No. 2 rotor at 60 rpm temperature: 23±1° C.

(c) Abrasion Characteristics

Measurement by Taber testing machine;

Device: Taber abrader

Measurement conditions

Sample preparation: resin solution coated on an aluminum disc and dried to form a coated film of about 50 μ

Whetstone model: CS17

Load: 1000 g

Rotational speed: 70 rpm

Total rotational number: 5000 rotations

Measurement environment:

temperature 23±1° C., humidity 55±5% RH.

Synthesis examples of the polycarbonate resins to be used in the present invention are shown below.

SYNTHESIS EXAMPLE 1

A mixture of 37 g (0.16 mol) of bisphenol A, 0.353 g of phenol, 16.8 g of NaOH and 238 ml of water was dissolved by heating to 50° C. and thereafter cooled to 25° C., followed by addition of 147 ml of methylene chloride. Subsequently, under stirring at 25° C., 19.1 g of phosgene was introduced over 60 minutes. Then, 0.0342 g of trimethylbenzylammonium chloride, 4.5 g of NaOH and 30 ml of water were added, and thereafter polymerization was carried out for 4 hours under stirring at 25° C. After completion of polymerization, the mixture was diluted with addition of 360 ml of methylene chloride, washed with hydrochloric acid under weakly acidic conditions, followed further washing with water (×5). The polymer solution was thrown into methanol to effect coagulation, and the polymer was dried at 100° C. under 1 mmHg for 15 hours.

When the thus obtained bisphenol A type polycarbonate resin represented by the following structural formula was subjected to measurement of number average molecular weight according to the method previously shown, it was found to be $2.6\times10^4$.

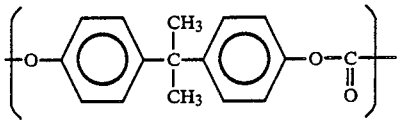

On the other hand, by varying the amount of phenol added and polymerization time during synthesis, polymers having number average molecular weights of $1.0\times10^4$ and $6.0\times10^4$ were synthsized.

SYNTHESIS EXAMPLES 2–4

By use of the diol compounds as the starting material in place of the polycarbonate resin shown in Synthesis Example 1, polycarbonate resins having different molecular weights were synthesized under the same conditions as in Synthesis Example 1.

| Synthesis example | Starting material diol | Number average molecular weight ($10^4$) |
|---|---|---|
| 2 | 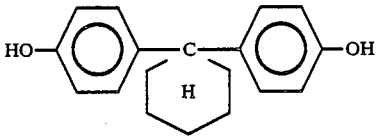 | 0.6<br>1.2<br>4.8<br>7.5 |
| 3 | 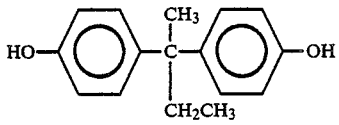 | 0.8<br>5.5 |
| 4 | 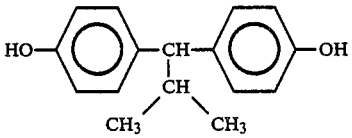 | 0.5<br>8.0 |

EXAMPLE 1

An aluminum cylinder of 60 $\phi\times260$ mm was used as the substrate. This substrate was coated with a 5% methanol solution of a polyamide resin (trade name: Amilan CM-8000, produced by Toray) according to the dip method to provide a subbing layer with a thickness of 0.5 $\mu$m.

Next, 10 parts (parts by weight, hereinafter the same) of a disazo pigment having the following structural formula:

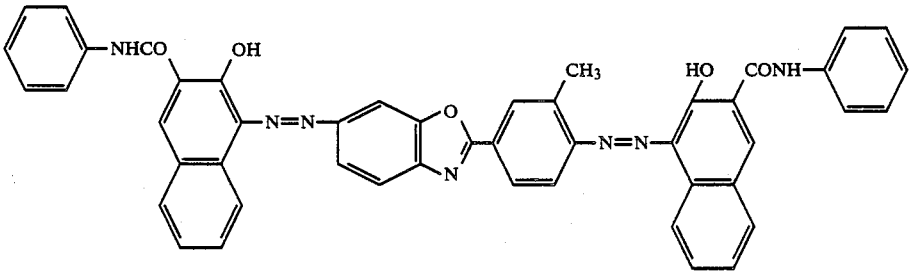

8 parts of a polyvinylbutyral resin (trade name: S-lec BXL, produced by Sekisui Kagaku K.K.) and 50 parts of cyclohexanone were dispersed by means of a sand mill device by use of 1 $\phi$ mm glass beads for 20 hours. To the dispersion were added 70 to 120 parts (as desired) of methyl ethyl ketone and the mixture was applied on the subbing layer to form a charge generation layer with a film thickness of 0.15 $\mu$m.

Next, 10 parts of a hydrazone compound having the structural formula shown below:

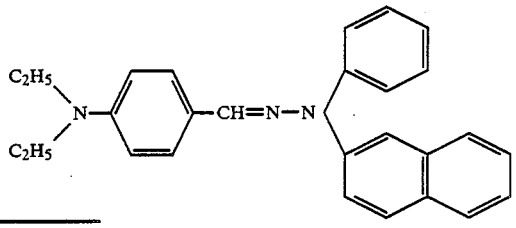

8.5 parts of the polycarbonate having a number average molecular weight of $1.0\times10^4$ obtained in Synthesis example 1 and 1.5 parts of a polycarbonate having a number average molecular weight of $6.0\times10^4$ were dissolved in 20 parts of monochlorobenzene, 20 parts of THF and 15 parts of dichloromethane. The solution was applied on the charge generation layer by the dip method and dried in hot air at 105° C. for 80 minutes to form a charge transport layer with a thickness of 18 $\mu$m.

The charge transport layer coating solution at this time had a viscosity of 175 cps and the withdrawing speed for obtain a coated film of 18 μm was 120 mm/min.

The electrophotographic photosensitive member thus prepared was subjected to image evaluation after repeated copying by mounting on an electrophotographic copying machine having the steps of corona charging of −5.6 kV, image exposure, dry system toner development, toner transfer onto plain paper, cleaning by a urethane rubber blade (hardness 70°, pressure 5 gw/cm, angle relative to photosensitive member 20°), etc. Also, the upper and lower film thickness difference of the charge transport layer of the photosensitive member was measured. The "upper" of the photosensitive member herein mentioned refers to the upper side when coated by withdrawing upwardly.

On the other hand, abrasion characteristics of the polycarbonate compositions used in the photosensitive members were measured. Those results are shown in Table 1.

EXAMPLE 2

A photosensitive member was prepared in the same manner as in Example 1 except for using 7 parts of the polymer having a number average molecular weight of $0.6\times10^4$ and 3 parts of the polymer having a number average molecular weight of $7.5\times10^4$ obtained in Synthesis Example 2 as the polycarbonate, and 44 parts of monochlorobenzene and 11 parts of dichloroethane as the solvent. The charge transport layer coating solution at this time had a viscosity of 190 cps and the withdrawing speed for obtaining a coated film of 18μ was 110 mm/min. The results of measurement and evaluation conducted similarly as in Example 1 are shown in Table 1.

COMPARATIVE EXAMPLE 1

A photosensitive member was prepared in the same manner as in Example 1 except for using the polymer having a number average molecular weight of $2.6\times10^4$ obtained in Synthesis Example 1 as the polycarbonate. The charge transport layer coating solution at this time had a viscosity of 205 cps, and the withdrawing speed for obtaining a coated film of 18μ was 95 mm/min.

The results of measurement and evaluation conducted similarly as in Example 1 are shown in Table 1.

COMPARATIVE EXAMPLE 2

A photosensitive member was prepared in the same manner as in Example 1 except for using 10 parts of the polymer having a number average molecular weight of $1.2\times10^4$ obtained in Synthesis Example 2 as the polycarbonate and 40 parts of monochlorobenzene and 10 parts of dichloroethane as the solvent. The charge transport layer coating solution at this time had a viscosity of 90 cps and the withdrawing speed for obtaining a coated film of 18μ was 200 mm/min.

The results of measurement and evaluation conducted similarly as in Example 1 are shown in Table 1.

TABLE 1

| Photosensitive member | Image quality after repeated copying at 32.5° C., 90% RH | Image quality after repeated copying at 15° C., 20% RH | Upper and lower film thickness difference of the charge transport layer (μ) | Abraded amount ($cm^3$) |
|---|---|---|---|---|
| Example 1 | Good quality after copying of 5000 sheets as unchanged from the initial stage | Good quality after copying of 5000 sheets as unchanged from the initial stage | 2 | $4.1\times10^{-2}$ |
| Example 2 | Good quality after copying of 5000 sheets as unchanged from the initial stage | Good quality after copying of 5000 sheets as unchanged from the initial stage | 1.5 | $4.8\times10^{-2}$ |
| Comparative example 1 | Image flow occurred after copying of 500 sheets | Unfocused image occurred after copying of 2000 sheets | 1.5 | $2.0\times10^{-2}$ |
| Comparative example 2 | No image flow at copying of 5000 sheets, but image irregularity occurred from the initial stage | No unfocused image at copying of 5000, but black streaks due to frictional damage occurred | 6.5 | $8.2\times10^{-2}$ |

EXAMPLE 3

A photosensitive member was prepared in the same manner as in Example 2 except for using 9 parts of the polymer having a number average molecular weight of $1.2\times10^4$ and 1 part of the polymer having a number average molecular weight of $4.8\times10^4$ obtained in Synthesis Example 2 as the polycarbonate.

EXAMPLE 4

A photosensitive member was prepared in the same manner as in Example 1 except for using 6 parts of the polymer having a number average molecular weight of $0.8\times10^4$ and 4 parts of the polymer having a number average molecular weight of $5.5\times10^4$ obtained in Synthesis Example 3 as the polycarbonate.

EXAMPLE 5

A photosensitive member was prepared in the same manner as in Example 1 except for using 7.5 parts of the polymer having a number average molecular weight $0.5\times10^4$ and 2.5 parts of the polymer having a number average molecular weight of $8.0\times10^4$ obtained in Synthesis Example 4 as the polycarbonate.

For the photosensitive members prepared in Examples 3-5, evaluations as described above were conducted. The results are shown in Table 2.

TABLE 2

| Photosensitive member | Image quality after repeated copying at 32.5° C., 90% RH | Image quality after repeated copying at 15° C., 20% RH | Upper and lower film thickness difference of the charge transport layer (μ) | Abraded amount ($cm^3$) |
|---|---|---|---|---|
| Example 3 | Good quality after copying of 8000 sheets as unchanged from the initial stage | Good quality after copying of 8000 sheets as unchanged from the initial stage | 1.5 | $4.2 \times 10^{-2}$ |
| Example 4 | Good quality after copying of 8000 sheets as unchanged from the initial stage | Good quality after copying of 8000 sheets as unchanged from the initial stage | 1.5 | $5.5 \times 10^{-2}$ |
| Example 5 | Good quality after copying of 8000 sheets as unchanged from the initial stage | Good quality after copying of 8000 sheets as unchanged from the initial stage | 2 | $4.6 \times 10^{-2}$ |

As shown in Comparative Example 2, when only a polycarbonate with low molecular weight is used, the upper and lower film thickness difference of the photosensitive is great due to too low a viscosity of the charge transport layer coating solution, and excessive image irregularity occurs to make the photosensitive member practically unuseful. Also, abrasion resistance is too low and therefore friction damage occurs on the surface after repeated copying and black streaks appear on the image. In contrast, in Examples 1–5 comprising blends of low molecular weight and high molecular weight polymers, adequate coating solution viscosities could be obtained, and therefore the upper and lower thickness difference of the photosensitive member is sufficiently small to be on a level without problem. Besides, there is not image deterioration such as image flow, unfocused image which have been conspicuously seen in the photosensitive member of Comparative Example 1 in which the polymer of the molecular weight conventionally used in the prior art was used. Thus, the photosensitive member according to the present invention can give constantly good image quality, and is extremely suitable particularly for a small scale electrophotographic copying machine.

I claim:

1. An electrophotographic photosensitive member comprising a photosensitive layer of a charge generation layer and a charge transport layer on an electroconductive substrate, the surface layer of said charge transport layer comprising at least one of polycarbonate resins (I) having a number average molecular weight of $1.5 \times 10^4$ or less and at least one of polycarbonate resins (II) having a number average molecular weight of $4.5 \times 10^4$ or more, said polycarbonate resin (I) being contained at a proportion of 30 parts by weight to 95 parts by weight based on 100 parts by weight of the composition comprising the polycarbonate resins (I) and (II).

2. An electrophotographic photosensitive member according to claim 1, wherein said charge transport layer is provided by coating on the charge generation layer.

3. An electrophotographic photosensitive member according to claim 1, wherein the mixing ratio of the charge transporting material contained in said charge transport layer to the composition comprising the polycarbonate resins (I) and (II) is 2:1 to 1:2.

4. An electrophotographic photosensitive member according to claim 1, wherein the charge transporting substance contained in said charge transport layer is a carbazole type compound, hydrazone type compound, pyrazoline type compound, oxazole type compound, thiazole type compound, triarylmethane type compound or polyarylalkane type compound.

5. An electrophotographic photosensitive member according to claim 1, wherein said charge transport layer has a film thickness ranging from 5 to 40 μm.

6. An electrophotographic photosensitive member according to claim 2, wherein the mixing ratio of the charge transporting material contained in said charge transport layer to the composition comprising the polycarbonate resins (I) and (II) is 2:1 to 1:2.

7. An electrophotographic photosensitive member according to claim 2, wherein the charge transporting substance contained in said charge transport layer is a carbazole type compound, hydrazone type compound, pyrazoline type compound, oxazole type compound, thiazole type compound, triarylmethane type compound or polyarylalkane type compound.

8. An electrophotographic photosensitive member according to claim 2, wherein said charge transport layer has a film thickness ranging from 5 to 40 μm.

* * * * *